United States Patent [19]

Hamm

[11] Patent Number: 4,965,407

[45] Date of Patent: Oct. 23, 1990

[54] MODULAR BUSHING

[75] Inventor: Sidney R. Hamm, Muskego, Wis.

[73] Assignee: Cooper Industries, Inc., Houston, Tex.

[21] Appl. No.: 282,700

[22] Filed: Dec. 9, 1988

[51] Int. Cl.[5] ..... H01B 17/26

[52] U.S. Cl. ..... 174/31 R; 174/142; 174/152 R

[58] Field of Search ..... 174/11 BH, 12 BH, 14 BH, 174/15.3, 18, 31 R, 31.5, 137 B, 142, 143, 152 R, 153 R, 167

[56] References Cited

U.S. PATENT DOCUMENTS

| | | | |
|---|---|---|---|
| 1,230,610 | 6/1917 | Sonneborn | 174/143 |
| 1,490,419 | 4/1924 | Eby | 174/31 R X |
| 2,160,660 | 5/1939 | Hobart | 174/18 X |
| 3,049,581 | 8/1962 | Palmieri | 174/142 X |
| 3,178,505 | 4/1965 | Van Sickle | 174/31 R |
| 3,222,625 | 12/1965 | Ledocq | 174/142 X |
| 3,234,322 | 2/1966 | Frowein | 174/31 R X |
| 3,318,995 | 5/1967 | Buckley et al. | 174/142 |
| 3,433,893 | 3/1969 | Hofmann et al. | 174/137 B X |
| 3,604,830 | 9/1971 | Frakes | 174/31 R |
| 3,643,003 | 2/1972 | Graybill | 174/18 |
| 3,784,733 | 1/1974 | Farmer et al. | 174/153 R |
| 3,865,968 | 2/1975 | Heumann et al. | 174/15.3 |
| 4,431,859 | 2/1984 | Kishida | 174/31 R |
| 4,454,373 | 6/1984 | Kishida | 174/31 R |
| 4,730,231 | 3/1988 | Tanigaki et al. | 174/18 X |

FOREIGN PATENT DOCUMENTS

| | | | |
|---|---|---|---|
| 2658291 | 6/1978 | Fed. Rep. of Germany | 174/152 R |
| 3709544 | 10/1987 | Fed. Rep. of Germany | 174/31 R |
| 1544485 | 4/1979 | United Kingdom | 174/31 R |

OTHER PUBLICATIONS

Advertisment: "Hopewell Points the Way to Better Insulation", *Electrical World*, vol. 77, No. 8, Feb. 19, 1921, p. 72, Copy in 174–142.

*Primary Examiner*—Laramie E. Askin

*Attorney, Agent, or Firm*—David A. Rose; Donald J. Verplancken; Ned L. Conley

[57] ABSTRACT

A bushing system for high voltage electrical equipment includes a weathershed with integral annular shirts molded around an electrical conductor. The weathershed has a cavity at its base for mating with the opening in the housing for the high voltage electrical equipment. A dielectric gas in the housing communicates with the cavity in the weathershed. A flange and seal are provided at the base of the weathershed for sealingly connecting the bushing system to the housing. A secondary ground may also be provided.

23 Claims, 2 Drawing Sheets

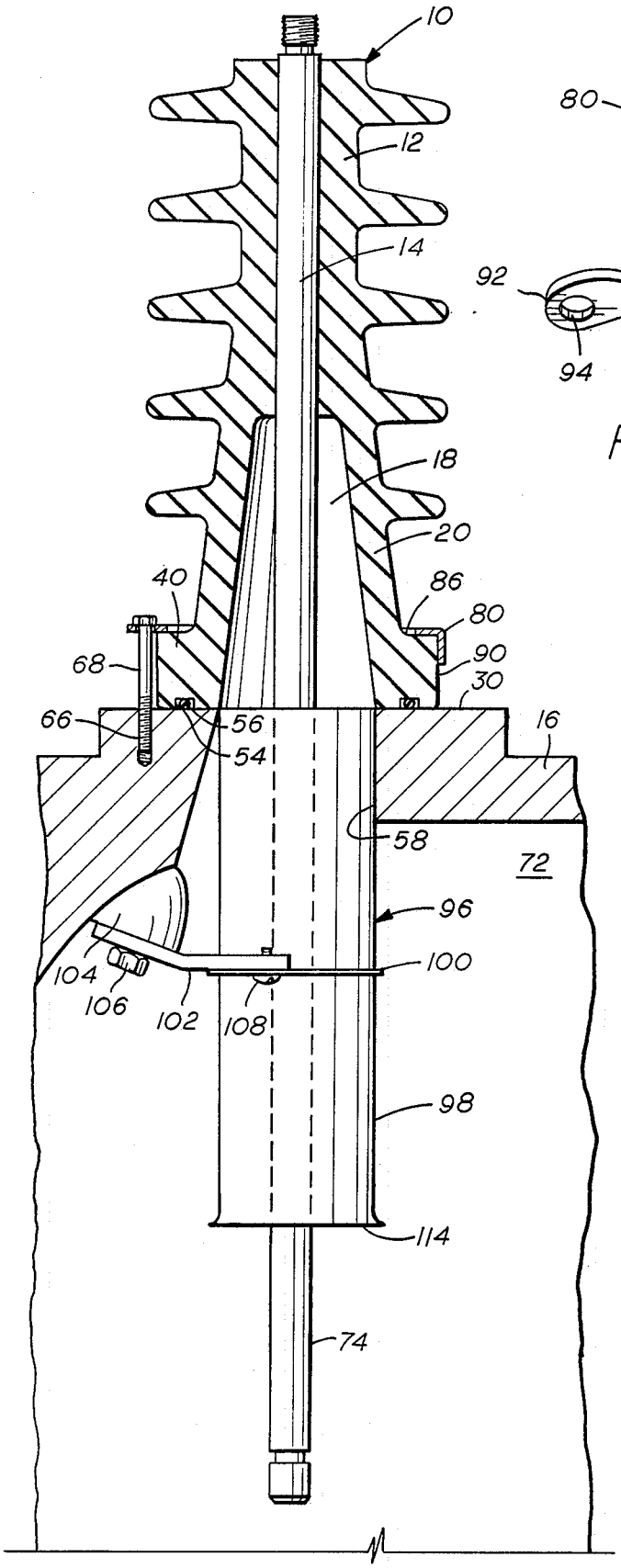
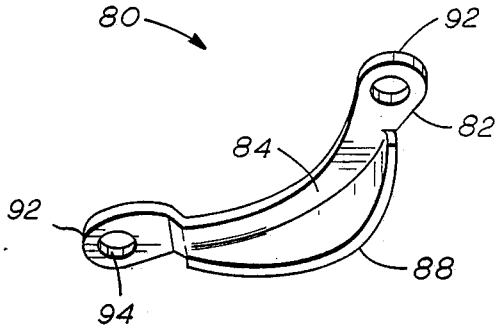
FIG. 2
FIG. 3

MODULAR BUSHING

BACKGROUND OF THE INVENTION

The present invention relates to terminal bushings and more particularly to terminal bushings used with electrical equipment containing dielectric gases or liquids.

Terminal bushings are employed in high voltage electrical equipment to prevent arcing, or flashover, between the grounded shell or tank surrounding the equipment and the line, or conductor, projecting therefrom. A typical bushing consists of a skirted weathershed which surrounds the conductor. The electric potential between the conductor and equipment is commonly sufficient to cause flashover through the air between the conductor and equipment in the absence of a bushing. Bushings are made from electrically insulative materials, such as ceramics or epoxy resins. However, at the high voltages with which the bushings are used, the possibility of flashover exists even with such insulative materials.

Electric flashover may occur along several distinct paths, or along a combination of these paths. One potential flashover path is along the outer skin of the bushing from its apex, adjacent the protruding conductor, to the tank housing the electrical equipment. A second path exists along the inner skin of the bushing from its base, adjacent the conductor, to the tank. The conductor may flashover through the wall of the bushing to the tank. In bushings having internal cavities, a flashover may occur from the conductor across the cavity and onto the tank.

To prevent flashover along the skin of the bushing, the linear distance of the bushing skin from the tank to the apex of the bushing adjacent the conductor, called the string distance, is increased by employing a series of skirts. The outer surface, or skin of the bushing, has a relatively constant dielectric strength, or resistance to current flow, per given increment of length. Therefore, the skirts increase this length thereby increasing the overall dielectric strength of the bushing. The skirts extend from the exterior of the bushing in the form of circular fins. To minimize the conductivity of the bushing within the tank, and to likewise minimize its ,length therein, the tank is commonly filled with a dielectric medium such as $SF_6$ gas. The bushing material will have a lower surface conductivity in a dielectric gas than in air, and therefore the string distance from the protrusion of the conductor through the base of the bushing to the tank can be substantially less than the string distance from the apex of the bushing to the tank.

Generally, prior art bushings have two internal constructions: a solid core surrounding the conductor, or a hollow core having seals adjacent the ends of the bushing to prevent the escape of the dielectric medium. The prior art includes bushings made from ceramic as well as resinous materials.

Solid core bushings have several disadvantages. First and foremost, they take little advantage of the dielectric medium in the tank, and therefore must surround the conductor a substantial distance into the tank to prevent flashover. Likewise, they tend to be bulky and heavy, which requires a large amount of raw material.

Prior art hollow bushings suffer the disadvantage of having several leak paths for escape of the dielectric gas. For example, U.S. Pat. No. 4,431,859 to Kishida discloses a hollow bushing. It should be appreciated that the bushing of Kishida requires the use of a seal at its apex to prevent the escape of gas, as well as a seal adjacent the base of the bushing near the tank.

U.S. Pat. No. 3,178,505 to Van Sickle discloses a terminal bushing for gas-filled transformer applications. The disclosed device includes an inverted conical insulator section which protrudes within the bushing. However, the entire bushing is hollow and filled with the insulating gas. As in Kishida, the bushing requires seals at each end of the bushing.

Other objects and advantages of the present invention will appear from the following description.

SUMMARY OF THE INVENTION

The present invention includes a terminal bushing for high voltage applications having a skirted weathershed molded directly to a conductor and having a cavity partially intruding into the weathershed from the base of the bushing coaxial within the conductor and open to the tank. In the preferred embodiment of the invention, the base of the bushing includes a flange at the base of the bushing for connection of the bushing to the tank. The flange includes a seal groove, for housing a seal which prevents leakage of the dielectric medium at the connection between the bushing and the tank. The internal cavity preferably terminates at or before the second skirt of the weathershed.

The molding of the conductor into the weathershed has the following advantages:

(1) Mechanical support and alignment of the conductor.
(2) Sealing of the internal $SF_6$ gas and of the external environment.
(3) Elimination of seals and clamping means.
(4) Allows for various sizes of conductors and conductor material.
(5) Allows for a variation of the bushing height and creep for variations of bushing voltage rating by using a modular mold.

The $SF_6$ gas cavity has the following advantages over a solid bushing:

(1) The weathershed diameter is minimized since the electric field equipotential lines are pushed into the gas cavity reducing the field gradient at the air-to-bushing surface.
(2) A reduction of weight and material costs is effected whereby the bushing is smaller and yet has equal dielectric strength to that of prior art bushings.
(3) Does not require additional field gradings such as shields, conductive coatings or grading planes, except at higher voltages.
(4) Requires a minimum, number of potential leak paths for the dielectric medium.

BRIEF DESCRIPTION OF THE DRAWINGS

For a detailed description of a preferred embodiment of the invention, reference will now be made to the accompanying drawings wherein:

FIG. 2 is a perspective view of an alternate clamp used to attach the bushing and tank of FIG. 3; and FIG. 3 is a partial cross-sectional view of an alternate embodiment of the terminal bushing of FIG. 2 mounted on an equipment tank.

Figure 1:
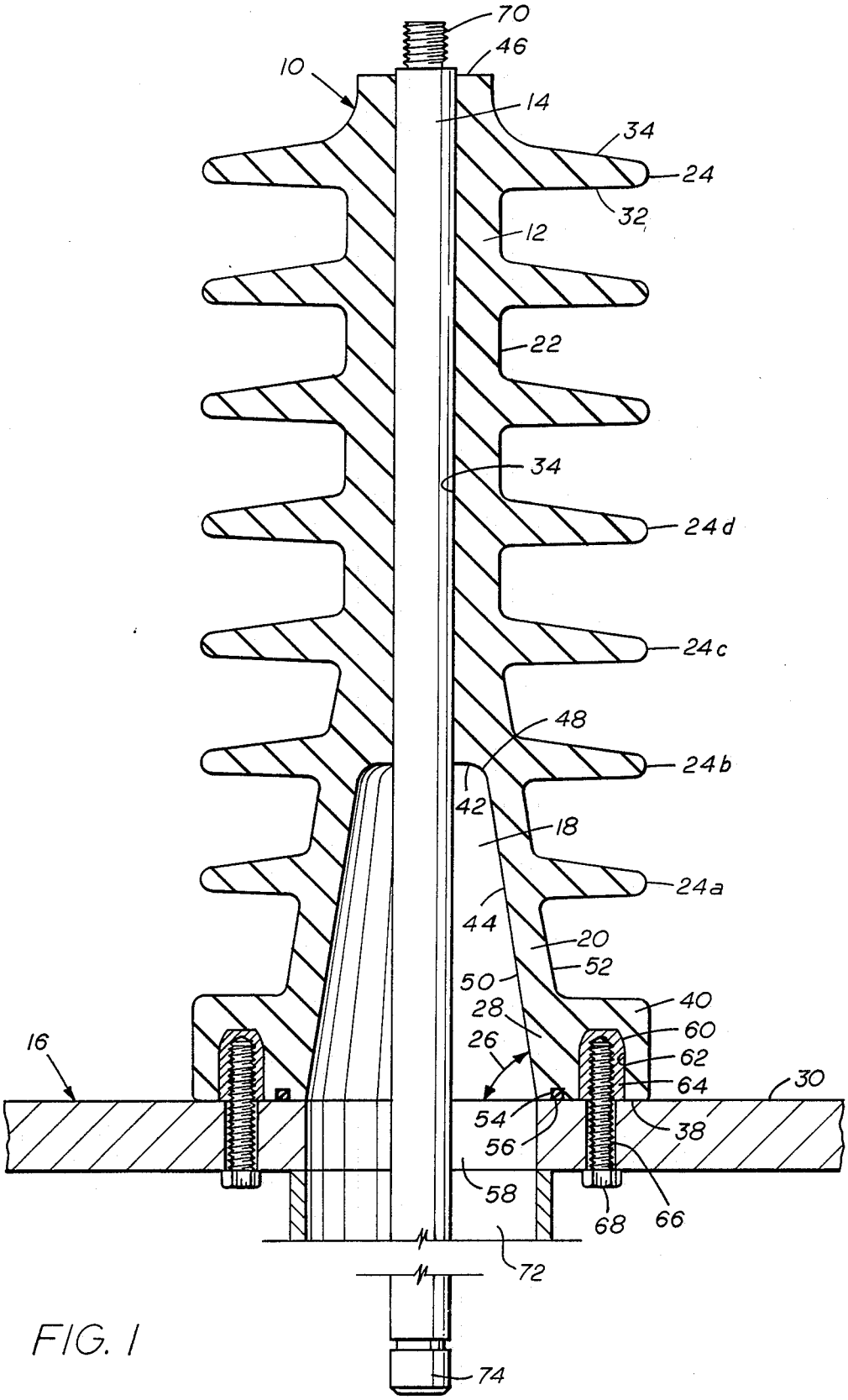
FIG. 1 is a cross-sectional view of the bushing of the present invention mounted on a tank.

The invention may take form in various parts and arrangements of parts. The drawings are only for the purpose of illustrating the preferred embodiment of the present invention and are not to be construed as limiting it.

DESCRIPTION OF THE PREFERRED EMBODIMENTS

Referring initially to FIG. 1, the bushing assembly 10 of the present invention includes a weathershed 12 and a plurality of annular fins or skirts 24 integrally formed on the exterior of weathershed 12. Weathershed 12 is molded around a conductor 14 for attachment to a shell or tank 16. The bushing assembly 10 is made of an insulating material such as epoxy resin material or other appropriate insulating material. Preferably, bushing assembly 10 is made of a cycloaliphatic epoxy resin for outdoor use. The weathershed 12 also includes a cone-shaped cavity 18 for receiving a dielectric medium from the adjacent tank 16. Cycloaliphatic epoxy resin is particularly suited for containing such dielectric medium such as $SF_6$ gas.

The weathershed 12 of bushing assembly 10 is generally cone-shaped having a lower conical portion 20 and an upper cylindrical riser portion 22. The conical portion 20 is in the form of a truncated cone having a small cone angle 26, preferably less than 10 degrees. The base 28 of conical portion 20 engages or abuts the external surface 30 of the tank 16. The base 28 includes an abutment or depending flange 40 therearound. The circular base 28 is diametrically larger than the cylindrical riser portion 22 of weathershed 12 so as to contribute to the overall stability of the bushing assembly 10 when mounted on tank 16. The conical base portion 20 and cylindrical riser portion 22 are integral and continuous in forming weathershed 12. The annular fins or skirts 24 are spaced along the exterior of weathershed 12. The skirts 24 preferably have a common outer diameter and are substantially equally spaced along the length of the outer surface of weathershed 12. The underside 32 of each skirt 24 is preferably parallel to the lower surface 38 of base 28 which contacts tank 16. The upper side 34 of each skirt 24 is preferably sloped downwardly to permit drainage of water or other accumulants.

The cavity 18 of bushing assembly 10 is molded into the interior of conical portion 20. The molding of weathershed 12 around the conductor 14 forms a bore 36 which extends through the upper cylindrical riser portion 22 from the top 42 of cavity 18 to the top or apex 46 of weathershed 12 The top 42 of cavity 18 terminates colinearly with the second skirt 24*b*. Cavity 18 includes smooth inner wall 44 and top 42. Wall 44 and top 42 are blended at cavity radius 48. The interior and exterior surfaces 50, 52 respectively of conical portion 20 are substantially parallel so as to form a uniform wall thickness between the first two adjacent skirts 24*a* and 24*b* on the exterior of conical portion 20 adjacent cavity 18.

Flange 40 of base 38 is an integral part of weathershed 12 and includes an annular groove 54 in which is disposed an annular seal or gasket 56 of conductive rubber or synthetic elastomer material. The seal 56 is engaged about an opening 58 in the tank 16, such as in a housing cover or lid of the tank 16. Flange 40 also includes a plurality of anchors 60 for attaching the bushing assembly 10 to the tank 16. The anchors 60 preferably include three cavities 62 spaced around the circumference of the flange 40. A pre-threaded aluminum insert 64 is molded into each of the cavities 62 of flange 40. Tank 16 includes bolt holes 66 for receiving bolts 68 which threadingly engage the aluminum molded inserts 64 in the cavities 62 in flange 40.

The weathershed 12 sealingly surrounds the conductor 14. The upper end 70 of conductor 14 is threaded and projects from the bore 36 at the apex 46 of weathershed 12. Upper end 70 is threaded to receive a connector, such as a clamp or other piece of equipment (not shown), for connection to a power line or distribution system. The connector is threaded onto the projecting conductor end 70.

The conductor 14 extends from the interior 72 of tank 16 through the opening 58 in the cover of tank 16 and up through cavity 18 and bore 36 of weathershed 12. The lower end 74 of conductor 14 extending into the tank 16 is connected to a transformer or other electrical equipment housed within tank 16. The interior 72 of tank 16 is filled with a dielectric material, preferably $SF_6$ gas, to suppress flashover. The molding of weathershed 12 around conductor 14 seals the bushing assembly 10 around the conductor 14 thereby preventing the escape of any dielectric medium contained within the tank 16 past the bushingtank interface. Conductor 14 carries an electric current and has an electric potential substantially equal to the rated line voltage of the equipment (not shown) housed in tank 16. Typically, the tank 16 may include equipment used in high voltage distribution systems. The tank 16 is grounded, and therefore has a potential of approximately zero (0) volts. Conductor 14 is typically made of copper or aluminum, although other conducting materials could be employed without deviating from the scope of the present invention.

Referring now to FIGS. 2 and 3, there is shown an alternative embodiment of the means for attaching the bushing assembly 10 to the tank 16. A clamp 80 is shown for mounting around flange 40. Clamp 80 is a segmented clamp having three identical 120° segments 82. Each segment 82 includes a horizontal portion 84 which is parallel to the upper surface 86 of flange 40 and a vertical portion 88 integral with and perpendicular to horizontal portion 84. Horizontal portion 84 engages and bears against the top 86 of flange 40 and vertical portion 88 engages the side 90 of flange 40. Vertical portion 88 is an arcuate retainer extending at a substantially right angle to horizontal portion 84 and designed to abut the outer diameter of flange 40. Horizontal and vertical portions 84, 88 are rounded and dimensioned to conform to flange 40. An offset 92 is provided at each end of clamp segment 82 and extends away from flange 40. Each offset 92 has a mounting hole 94 therethrough for alignment with bolts 68 projecting through bolt holes 66 in tank 16. Offset 92 permits bolts 68 to engage tank 16 diametrically exterior of flange 40. Alternatively, bushing 10 may also be directly bolted to tank 16 under appropriate circumstances.

In assembly, the bushing assembly 10 is molded around conductor 14 with the upper end 70 of conductor 14 projecting from the apex 46 of weathershed 12. The conductor 14 is thus sealingly surrounded by resin. The lower end 74 of conductor 14 projects from the cavity 18 of conical portion 20 through the hole 58 in tank 16 and into the interior 72 of tank 16. The O-ring 56 disposed in seal ring groove 54 sealingly engages the upper surface 30 of tank 16 about the opening 58. Bolts 68 are inserted in the threaded bolt holes 66 of tank 16. As the bolts 68 are threaded, the O-ring seal 56 is urged against the surface 30 of tank 16 and into sealing engagement therewith. A dielectric gas, such as $SF_6$, is disposed within the interior 72 of tank 16 housing electrical equipment. The dielectric gas passes through the opening 58 of tank 16 and fills cavity 18. The dielectric gas is sealed within cavity 18 by the o-ring seal 56.

By molding cavity 18 in weathershed 12 and molding weathershed 12 directly about conductor 14, the bushing system 10 is self-sealing and uses a minimum of material adjacent the tank 16 because the dielectric gas protects the area of the conductor 14 adjacent the tank 16 from flashover. Further, the area of the weathershed 12 surrounding conductor 14 is sufficient to support conductor 14 on tank 16. By partially extending cavity 18, the electric potential field in the bushing 10 is increased, thereby reducing the field on the exterior of the weathershed 12.

Although a bushing having multiple skirts and a cavity extending to the second skirt **24*b* has been described, it is contemplated that the invention may be practiced wherein the cavity 18 extends from one-and-a-half to two-and-a-half skirts, and the outer portion of the weathershed 12 which is molded to the conductor 14** extends at least one-half of a skirt. Thus, bushings with as few as two skirts may be employed without deviating from the scope of the invention.

In a 15.5 KV bushing, it has been found that under the above constraints, flashover can be prevented with a 5 skirt bushing approximately 10.5 inches long, where the conical portion 20 terminates after the third skirt **24*c*. The height of cavity 18 extends into weathershed 12** approximately 4.5 inches, and has a wall thickness of approximately 0.5 inch.

In a 27 KV bushing, it has been found that under the above constraints, flashover can be prevented with a 7 skirt bushing approximately 13 inches long, where the conical portion 20 terminates at the fourth skirt **24*d*. The cavity 18 extends into weathershed 12** approximately 4.5 inches, and has a wall thickness of approximately 0.5 inch.

By employing epoxy as the weathershed 12 material under the above conditions, it has been found that weathershed 12 can withstand a static cantilever load of 200 pounds applied to the conductor end 70 protruding from apex 46 with the bushing system 10 clamped to tank 16. Also, the bushing system 10 can withstand ambient temperatures of between −40° and 40° C., and service temperatures of between −40° and 105° C. Finally, although the bushing system 10 is designed to operate with 15 psig $SF_6$ gas, bushing system 10 will withstand 45 psig test pressure and 90 psig before rupturing occurs.

Referring again to FIG. 3, there is shown a secondary ground 96 which may be used with bushing system 10. A secondary ground 96 in the form of a metal, preferably thin aluminum, sleeve 98, is disposed coaxially about the lower end 74 of conductor 14. A flange 100 is affixed around the mid portion of sleeve 98 for mounting the sleeve 98 to a bracket 102 extending from a boss 104 in tank 16. Bracket 102 is preferably bolted to boss 104 at 106 and likewise bolted to flange 100 at 108 to secure sleeve 98 to tank 16. The upper end 110 of sleeve 98 extends through the opening 58 in tank 16 and is disposed substantially flush with the outer surface 30 of tank 16. Although sleeve 98 is shown projecting into tank 16, sleeve 98 may protrude into cavity 18. The inner end 112 of sleeve 98 is curled diametrically outward forming an annular lip 114. Sleeve 98 acts as a secondary ground to prevent flashover between conductor 14 and the electrical equipment within tank 16.

While a preferred embodiment of the invention has been shown and described, modifications thereof can be made by one skilled in the art without departing from the spirit of the invention.

I claim:

1. A modular bushing for mounting over an aperture of a tank having a dielectric medium therein, comprising;

an electrical conductor;

a weathershed of resin molded about and in contact with one end of said conductor for providing mechanical support of said conductor and for sealing said one end to said weathershed, said weathershed adapted for mounting said conductor to the tank and for insulating said conductor from the tank;

said weathershed having a lower mounting flange adapted for insulatively engaging the tank;

a cavity in said weathershed disposed circumferentially about said conductor and having an entrance adjacent said mounting flange; said cavity entrance adapted to be in communication with the aperture of the tank for receiving the dielectric medium; said cavity extending inward of said weathershed beyond said mounting flange;

said conductor having another end protruding from said weathershed through said cavity, for extending through the aperture and into the tank;

the string distance from said cavity entrance to the apex of said cavity being substantially greater than the linear distance between said conductor and said cavity entrance; and said cavity entrance adapted to be substantially the same size as the aperture.

2. The modular bushing of claim 1, wherein said weathershed has at least one skirt.

3. The modular bushing of claim 1, wherein said weathershed has a series of concentric skirts.

4. The modular bushing of claim 3, wherein there are at least three skirts in the series and said cavity extends into said weathershed a distance of between one and three skirts.

5. The modular bushing of claim 1, wherein said resin of said weathershed is epoxy resin.

6. The modular bushing of claim 5, wherein said epoxy resin is cycloaliphatic epoxy resin.

7. The modular bushing of claim 6, wherein said weathershed further includes a base adapted for mounting to said tank;

said base having a circular groove machined therein; and a seal ring disposed in said groove for sealing the interface of said base and said tank.

8. The modular bushing of claim 1 further including a secondary ground housed around a portion of said electrical conductor.

9. An improved bushing for mounting over an aperture in a high voltage compartment, comprising;

a cylindrical electrical conductor having opposed upper and lower end portions and a mid portion therebetween;

a weathershed having a cavity therein molded over said mid portion and having a plurality of skirts thereon;

said weathershed having a mounting base adapted for mounting said weathershed to the compartment, and an upper portion;

said upper end portion projecting from said upper portion, and said lower end portion exiting into said cavity and extending beyond said mounting base;

the intersection of said cavity with said base forming an orifice, said orifice adapted to have the same perimeter and cross-section as that of the aperture; and said cavity extending inward said weathershed from said orifice.

10. A modular bushing for mounting over an aperture in a tank filled with a dielectric medium to electrically connect electrical apparatus housed within the tank to an electrical power source disposed in air outside the tank, comprising:

a weathershed of resin having a cylindrical portion forming an apex and a conical portion forming a base;

said weathershed including a plurality of integral annular skirts evenly spaced along the exterior of said cylindrical and conical portions from said base to said apex;

said conical portion having a coaxial cone-shaped cavity forming a conical wall with a uniform thickness and an opening in said base adapted to be substantially the same size as that of the aperture, said cavity having a height substantially the length of said conical portion with at least one annular skirt projecting around said cavity;

an elongated electrical conductor having an electrically conductive circumferential surface;

said weathershed being molded around and in contact with one end of said conductor for mechanical support and alignment of said conductor whereby said conductor extends coaxially through said weathershed;

said molding hermetically sealing said conductor and weathershed;

said conductor having another end extending coaxially through said cone-shaped cavity and projecting therefrom for insertion through the aperture and into the tank;

said conductor having first connection means on said one end for connecting said conductor to the electrical power source and a second connection means on said other end adapted for connecting said conductor to the electrical apparatus in the tank;

said weathershed forming an external string distance extending from the point of contact between said conductor and cylindrical portion at said apex to the outer periphery of said base and an internal string distance extending from the point of contact between said conductor and conical portion within said cone-shaped cavity to the inner periphery of said opening of said base whereby said external string distance is substantially greater than said internal string distance;

said internal string distance being substantially greater than the distance between said circumferential surface of said conductor and the periphery of said opening in said base to prevent direct dielectric breakdown between said conductor and the tank without flashover occurring along the internal surface of said cavity in said conical portion;

means for mounting said base to the tank; and means for sealing between said base and the tank.

11. The modular bushing of claim 10 wherein said base includes a depending flange therearound.

12. The modular bushing of claim 10 wherein said base is diametrically larger than said cylindrical portion for overall stability when mounted on the tank.

13. The modular bushing of claim 10 wherein said skirts have a common outer diameter.

14. The modular bushing of claim 10 wherein said skirts have a first side parallel to said base and a second side sloping radially outward and downward.

15. The modular bushing of claim 10 wherein said sealing means includes an elastomeric seal disposed in an annular groove in said base adapted for sealingly engaging the tank.

16. The modular bushing of claim 10 wherein said base includes a plurality of anchors adapted for attachment to the tank.

17. The modular bushing of claim 16 wherein said anchors include a plurality of cavities spaced around the circumference of said base and a pre-threaded aluminum insert molded into each said cavity.

18. The modular bushing of claim 10 wherein said mounting means includes a clamp adapted for attachment to the tank which engages and bears against one side of said base.

19. The modular bushing of claim 18 wherein said clamp includes three segments having a horizontal portion parallel to a surface of said base and a perpendicular portion for engaging the outer periphery of said base.

20. The modular bushing of claim 19 wherein said segments further include offsets with holes for fastening to the tank.

21. The modular bushing of claim 10 further including a secondary ground.

22. The modular bushing of claim 21 wherein said secondary ground includes a metal sleeve coaxially disposed about said other end of said conductor and a bracket adapted for extending from said sleeve to the tank.

23. The modular bushing of claim 22 wherein an end of said sleeve is adapted to be attached to the tank and said bracket is attached to said sleeve and is adapted to be attached to the tank.

* * * * *